United States Patent [19]

Gray, III

[11] Patent Number: 4,569,631

[45] Date of Patent: Feb. 11, 1986

[54] HIGH STRENGTH FAN

[75] Inventor: Leslie M. Gray, III, Lincoln, Mass.

[73] Assignee: Airflow Research and Manufacturing Corp., Watertown, Mass.

[21] Appl. No.: 637,794

[22] Filed: Aug. 6, 1984

[51] Int. Cl.[4] ..... F04D 29/38

[52] U.S. Cl. ..... 416/189; 416/238; 416/DIG. 2; 416/169 A

[58] Field of Search ..... 416/189 R, 238, 169 A, 416/228, DIG. 2

[56] References Cited

U.S. PATENT DOCUMENTS

| | | | |
|---|---|---|---|
| 102,399 | 4/1870 | Hirsch | 416/DIG. 2 |
| 1,518,501 | 12/1924 | Gill | 416/189 R |
| 1,542,853 | 6/1925 | Callahan | 416/189 R X |
| 1,808,032 | 6/1931 | Gebers | 416/238 |
| 1,991,095 | 2/1935 | Hochstetter . | |
| 2,043,736 | 6/1936 | Charavay . | |
| 2,212,041 | 8/1940 | Pfautsch | 416/238 |
| 2,754,919 | 7/1956 | Blue | 416/238 |
| 3,826,591 | 7/1974 | Wilson | 416/189 R X |
| 3,972,646 | 8/1976 | Brown et al. | 416/223 R X |
| 4,358,245 | 11/1982 | Gray | 416/189 R |
| 4,459,087 | 7/1984 | Barge | 416/169 A X |
| 4,505,641 | 3/1985 | Tsuchikawa et al. | 416/169 A X |

FOREIGN PATENT DOCUMENTS

| | | | |
|---|---|---|---|
| 3033685 | 3/1981 | Fed. Rep. of Germany | 416/223 R |
| 148699 | 11/1981 | Japan | 416/236 R |
| 439249 | 12/1935 | United Kingdom | 416/228 R |
| 601160 | 4/1948 | United Kingdom | 416/228 R |

*Primary Examiner*—Everette A. Powell, Jr.

[57] ABSTRACT

A fan in which the root-to-tip net blade skew angle ($A_b$) (either forward or rearward) is less than ½ of the blade spacing; in a first radially inward region of the blade, the blade is rearwardly skewed as indicated by the leading edge skew angle ($A_e$); in a second region radially outward of the first region, the leading edge skew angle indicates a forward skew.

5 Claims, 5 Drawing Figures

FIG 1
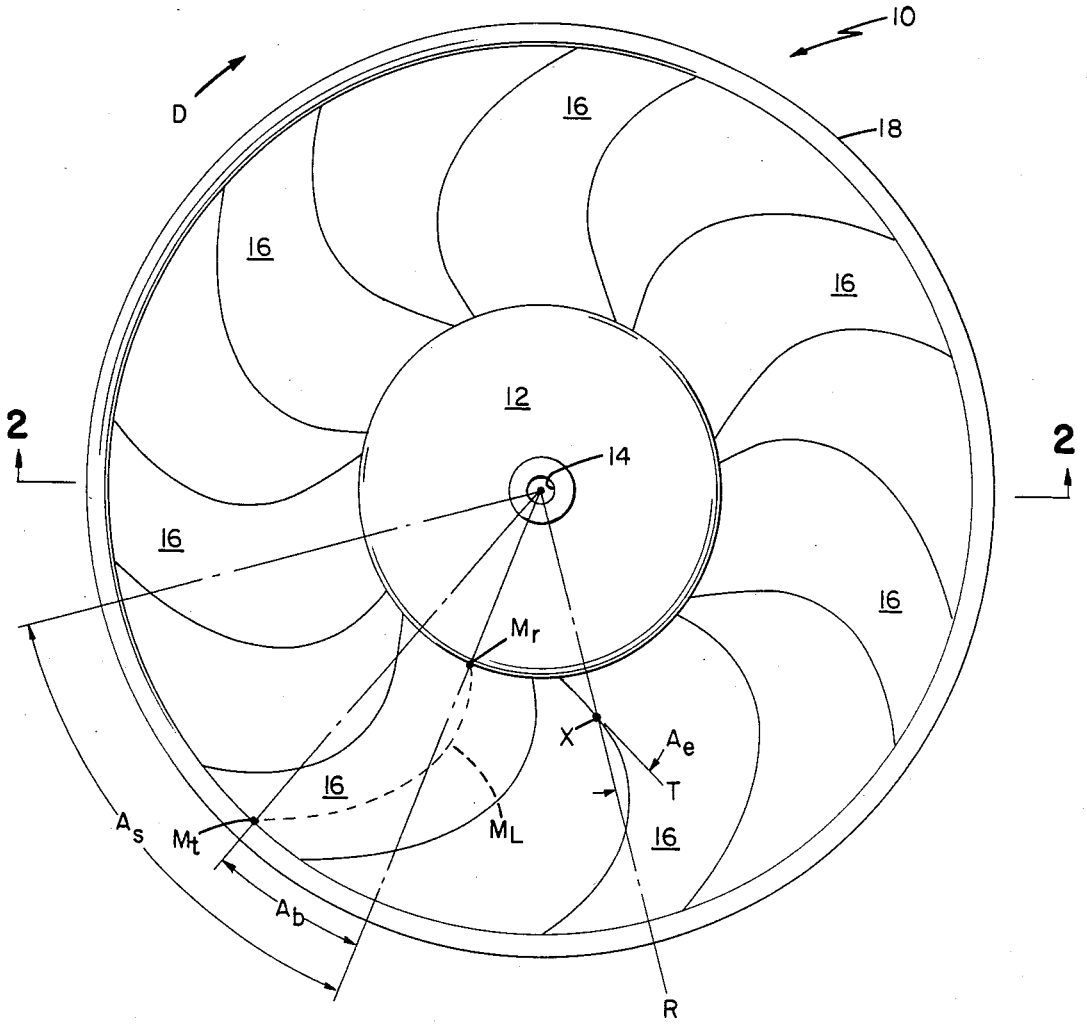
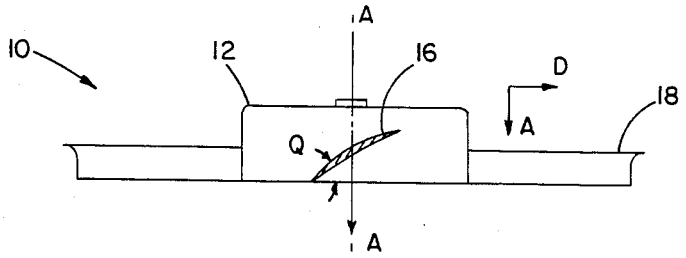
FIG 3

FIG 2
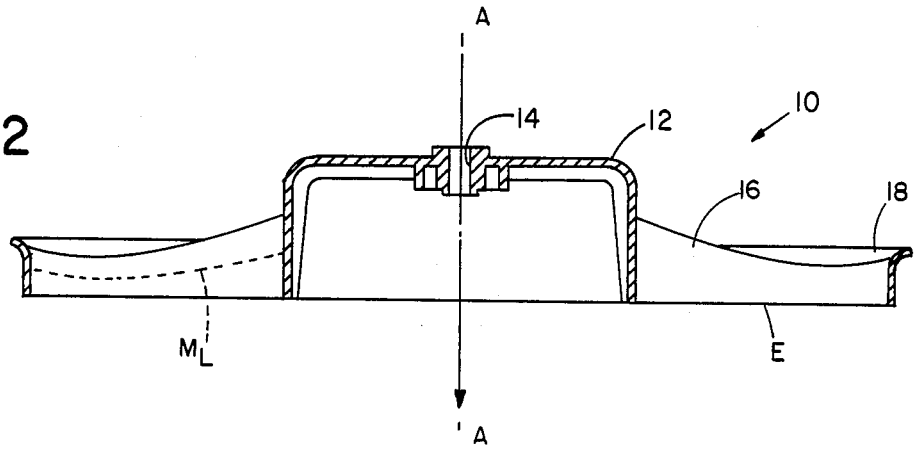
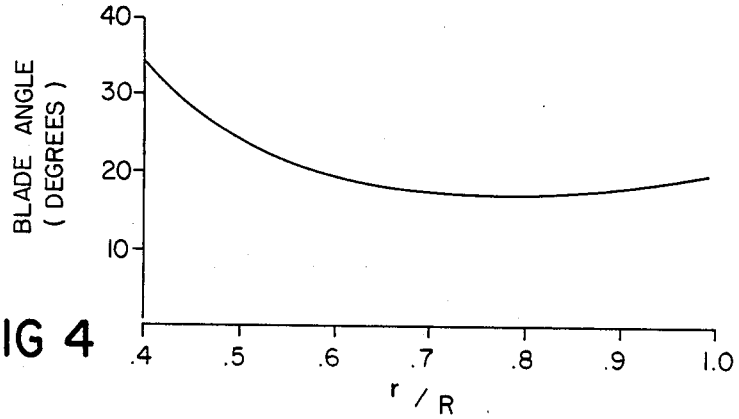
FIG 4
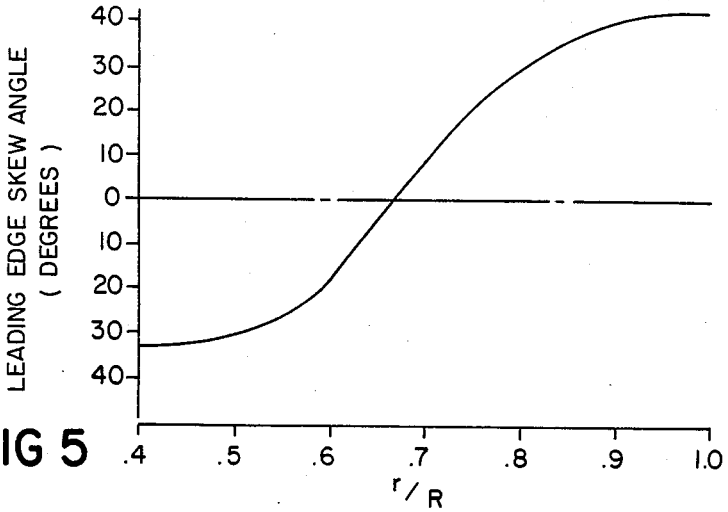
FIG 5

HIGH STRENGTH FAN

BACKGROUND OF THE INVENTION

This invention relates to fans designed to move air axially such as free-standing room fans or fans for moving air through a heat exchanger.

My U.S. Pat. No. 4,358,245 and my U.S. patent application Ser. No. 569,988 (filed Nov. 8, 1983), each of which is hereby incorporated by reference, describe various problems related to noise reduction and efficiency of axial-flow fans.

Specifically, the '245 patent discloses a fan with blades that are highly forwardly skewed along their entire length. In that context, skew is defined as the so-called "midpoint blade skew," the angle between a radius through the midpoint of the blade root and a radius through the midpoint of a chord at a given point on the blade. The high forward skew is designed to reduce noise, and, to accomplish that goal, the patent calls for a net blade skew angle (i.e., the mid-point blade skew from root to tip, see $A_b$ in FIG. 1) that is greater than $\frac{1}{2}$ of the blade spacing. The fan disclosed in that patent has a net blade skew angle of 39° and a blade spacing of 72°.

The '988 application discloses a fan in which the blade is rearwardly skewed to reduce noise and improve efficiency and compactness. The application is not concerned with the midpoint blade skew as defined above, but rather with the leading edge skew angle, illustrated in FIG. 1 as the angle $A_e$ between a tangent T at point X on the leading edge, and a radius R through the point. The leading-edge skew angle of the fan described in that application is 60° (rearward) at the tip of the blade.

For many applications such as automotive engines and air conditioner condensers, various competing factors such as compactness, efficiency (e.g. power required), strength, and weight must be taken into account.

SUMMARY OF THE INVENTION

I have discovered that skewing the fan blade to ensure a minimum root-to-tip midchord skew of more than $\frac{1}{2}$ of the blade spacing is not necessary for adequate noise control and is detrimental to fan strength. Specifically, my invention features a fan in which the root-to-tip net blade skew angle ($A_b$) (either forward or rearward) is less than $\frac{1}{2}$ of the blade spacing. In a first radially inward region of the blade, the blade is rearwardly skewed as indicated by the leading edge skew angle ($A_e$); in a second region radially outward of the first region, the leading edge skew angle indicates a forward skew.

In preferred embodiments, the net blade skew angle ($A_b$) is less than $\frac{1}{3}$ of the blade spacing. The first blade region (i.e. the back-skewed region) is confined to the radially innermost 70% of the blade. The leading edge skew angle is at least −30° (rearward) where the blade meets the fan hub, and at least +30° (forward) at the blade tip. The blade may be "raked" in that a radial midline of the blade (root-to-tip) may curve out of the plane of fan rotation. Forward rake, rearward rake, or a combination of forward and rearward rake may be used. Preferably, the rake is distributed to achieve a flat trailing fan edge. Finally, the blade angle (i.e., the angle Q in FIG. 3 between the plane of fan rotation and a blade surface section) is approximately constant (e.g., it does not vary more than ±10°) over the outer 30% of the blade.

By maintaining a small or negligible overall root-to-tip blade skew, the above-described fan avoids a significant source of fan weakness. Specifically, rotating fans generate considerable centrifugal force at the blade tip, and that force acts radially to "straighten" highly skewed blades. As a result, the blade unbends, tending to change significantly both the skew angle and the blade angle, thus reducing efficiency. In banded fans, this action may move the band out of its designed position relative to the fan plane of rotation, thus reducing its efficiency. When the overall skew, root-to-tip (angle $A_b$) is kept small relative to blade spacing ($A_s$), the centrifugal force acts along the blade's length at a relatively small angle with respect to the blade's midline, so there is less tendency to tilt the blade band or reduce the blade angle.

Accordingly, the band of the above-described fan need not be designed to resist such high bending forces, and the band and blade tip may be thinner and lighter without sacrificing efficiency.

Importantly, the combination of backward and forward skew provides not only noise reduction but also the low net blade skew necessary for strength as well as the compactness and efficiency of back-skewed fans.

Other features and advantages of the invention will be apparent from the following description of the preferred embodiment, drawings thereof, and from the claims.

DESCRIPTION OF THE PREFERRED EMBODIMENT

Drawings

FIG. 1 is a view of a combination skew fan taken from the upstream side;

FIG. 2 is a section taken along 2—2 of FIG. 1;

FIG. 3 is a schematic section of a blade showing the definition of blade angle Q.

FIG. 4 is a graph depicting blade angle of the fan of FIG. 1 versus radius;

FIG. 5 is a graph depicting leading edge skew of the fan of FIG. 1 versus radius;

STRUCTURE

FIGS. 1–3 depict a particular embodiment of the invention. The fan is designed for turbulent airflow such as that experienced by an automobile fan which moves air through a radiator or air conditioner cooler.

In FIG. 1, the fan 10 has a cylindrical hub section 12 for housing a motor (not shown). The motor shaft is attached to the hub at aperture 14 and thus rotates the fan in direction D to force air in direction A. A plurality (e.g. 7) of plastic blades 16 extend radially outward from hub 12 to their respective tips where they are joined to band 18. Band 18 is described in detail in my above-referenced patent and patent application.

For purposes of strength, the important factor to control is the net blade skew ($A_b$ between the midpoint [$M_r$] of the blade root and midpoint [$M_t$] of the blade tip). If the net blade skew is too large, then the fan will be vulnerable to the undesirable effects of centrifugal force described above. Specifically, the net blade skew should be less than $\frac{1}{2}$ (preferably less than $\frac{1}{3}$) of the blade spacing (the angle $A_s$ between radii to corresponding points on adjacent blades).

To achieve the appropriate net blade skew, each blade 16 is designed so that the mid-chord blade skew ($A_b$) is initially rearward (in the direction opposite to fan rotation) and becomes increasingly rearward until approximately the mid-span of the fan blade. The mid-chord skew angle decreases from the hub to the mid span of the blade, and then increases as the blade becomes forwardly skewed. In the particular embodiment of the fan shown in figures, the net blade skew is 13.5° at the blade tip ($r/R=1$, where R is the fan radius from the center of the fan to the blade tip, and r is the radius from the center of the fan to a point on the fan blade radially inward from the tip), which is less than $\frac{1}{3}$ blade spacing angle of 51.4°. While the above-described relationships are preferable, the benefits of the invention are obtained if the net skew angle $A_b$ is less than $\frac{1}{2}$ of the blade spacing $A_s$.

Noise reduction is a function of the leading edge skew angle ($A_e$) (not necessarily the net mid-chord blade skew). In the particular embodiment shown in the figures, the leading edge blade skew at the blade root is negative and remains so until about $r/R=0.65$, at which point $A_e$ is 0; from that point outward $A_e$ is increasingly positive to a value of about 40° at the tip.

The blade angle (the angle Q in FIG. 3) between the plane of fan rotation and a blade section, shown more specifically in my above-referenced pending patent application, is approximately constant, i.e., it does not vary more than ±10° in the outer 30% of the fan radius ($r/R>0.7$).

FIGS. 4–5 depict the mid-chord blade skew angle ($A_b$), the leading edge blade skew angle ($A_e$) and the blade angle (Q) of the fan of FIG. 1 as a function of fan radius, expressed as r/R defined as above.

Table 1 below shows the above angles as a function of r/R.

TABLE 1

| r/R | Mid-Chord Skew Angle ($A_b$) | Leading Edge Skew Angle ($A_e$) | Blade Angle (Q) |
|---|---|---|---|
| 0.4 | 0 | −33° | 33.1 |
| 0.5 | −5.0° | −30° | 24.6 |
| 0.6 | −7.0° | −18° | 19.6 |
| 0.7 | −5.5° | 8° | 17.2 |
| 0.8 | −1.0° | 29° | 17.0 |

TABLE 1-continued

| r/R | Mid-Chord Skew Angle ($A_b$) | Leading Edge Skew Angle ($A_e$) | Blade Angle (Q) |
|---|---|---|---|
| 0.9 | +5.0° | 40° | 18.1 |
| 1.0 | +13.5° | 41° | 19.9 |

The blade is "raked" in the downstream direction, meaning that the blade mid-line ML (moving root-to-tip) curves out of a plane perpendicular to the fan axis, toward the downstream direction and then back into that plane, thus tending to align the blade such that the trailing edge E of the fan is in a single plane.

Other aspects of the fan and blade are described in the above-referenced patent and patent application.

Other embodiments of the invention are within the following claims.

I claim:

1. A cooling fan, and means for maintaining said fan in association with a heat exchanger in position to move air through the heat exchanger, said fan comprising a hub rotatable on an axis, a plurality of plastic blades, each of which extends radially outward from a root region attached to said hub to a tip region, and a cylindrical band extending concentrically around said fan axis, said band connecting said blade tip regions, said blades being characterized in that:

(a) the leading edge of each said blade is rearwardly angled in said root region and forwardly angled in said tip region, said blades having a leading edge skew angle of at least 30° rearwardly in at least one portion of said root region and a leading edge skew angle of at least 30° forwardly in at least one portion of said tip region;

(b) said blades having a net mid-chord line blade skew less than $\frac{1}{2}$ of the blade spacing angle; and (c) said blades have a blade angle which is approximately constant for the position of the blade where r/R is greater than 0.7.

2. The fan of claim 1 wherein said net mid-chord blade skew angle is less than $\frac{1}{3}$ of the blade spacing angle.

3. The fan of claim 1 wherein said root region extends radially outward to a value of r/R of at least 0.6.

4. The fan of claim 1 wherein said net mid-chord blade skew angle is less than 30°.

5. The fan of claim 1 wherein said blades are raked to be out of the plane of rotation.

* * * * *

UNITED STATES PATENT AND TRADEMARK OFFICE

CERTIFICATE OF CORRECTION

PATENT NO. : 4,569,631

DATED : Feb. 11, 1986

INVENTOR(S) : Leslie M. Gray, III

It is certified that error appears in the above-identified patent and that said Letters Patent are hereby corrected as shown below:

Column 1, line 9, "569,988" is corrected to read --549,988--.

Signed and Sealed this

*Twenty-seventh* Day of *May 1986*

[SEAL]

*Attest:*

DONALD J. QUIGG

*Attesting Officer*

*Commissioner of Patents and Trademarks*